US012060773B2

(12) United States Patent
Murtaza

(10) Patent No.: US 12,060,773 B2
(45) Date of Patent: Aug. 13, 2024

(54) CONTROLLING A WELLBORE PRESSURE

(71) Applicant: Saudi Arabian Oil Company, Dhahran (SA)

(72) Inventor: Shoaib Murtaza, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/952,692

(22) Filed: Sep. 26, 2022

(65) Prior Publication Data

US 2024/0102358 A1 Mar. 28, 2024

(51) Int. Cl.
*E21B 36/00* (2006.01)
*E21B 33/13* (2006.01)

(52) U.S. Cl.
CPC ..... *E21B 36/00* (2013.01); *E21B 33/13* (2013.01)

(58) Field of Classification Search
CPC .... E21B 33/1208; E21B 33/128; E21B 33/03; E21B 21/08; E21B 47/06–07
See application file for complete search history.

(56) References Cited

U.S. PATENT DOCUMENTS 5,743,335 A * 4/1998 Bussear ..... E21B 33/16 166/242.7
7,048,059 B2 * 5/2006 Adams ..... E21B 43/088 166/227
2004/0216882 A1 * 11/2004 Horton ..... C09K 8/5751 166/305.1
2007/0114033 A1 * 5/2007 Hermes ..... C09K 8/42 166/371
2010/0122811 A1 * 5/2010 Maskos ..... E21B 34/063 166/243
2017/0183160 A1 * 6/2017 Hill ..... F17C 7/00
2018/0291251 A1 * 10/2018 Gamwell ..... C09K 8/40
2022/0341298 A1 * 10/2022 LaMascus ..... E21B 47/06

OTHER PUBLICATIONS

Yao, Theodore and Andrzej K. Wojtanowicz. "Criteria and risk of integrity loss for wells with sustained casing pressure." AGH Drilling,Oil,Gas 34 (2017): 639. (Year: 2017).*

* cited by examiner

*Primary Examiner* — Theodore N Yao
(74) *Attorney, Agent, or Firm* — Fish & Richardson P.C.

(57) ABSTRACT

A method for controlling a wellbore pressure. The method includes disposing a tubing within a casing of a wellbore to form a tubing casing annulus. The method includes installing a tubing-packer sealing assembly within the casing to seal a downhole portion of the wellbore from an uphole portion. The tubing is disposed in the uphole portion of the wellbore. The method includes filling the tubing casing annulus in with an annulus fluid. The method includes, after filling the tubing casing annulus with the annulus fluid, injecting a volume of inert gas into the tubing casing annulus causing an equal volume of the tubing casing annulus fluid to be flowed out of the wellbore. The method includes after injecting the volume of the inert gas, sealing the annulus fluid and the inert gas in the tubing casing annulus.

13 Claims, 5 Drawing Sheets

CONTROLLING A WELLBORE PRESSURE

TECHNICAL FIELD

This disclosure relates to controlling a wellbore pressure, in particular, in a tubing casing annulus of the wellbore by injecting an inert gas.

BACKGROUND

Fluids are trapped in subterranean reservoirs of the Earth. Wellbores are drilled from a surface of the Earth to those subterranean reservoirs to raise the fluids to the surface. Sometimes, additional equipment like casing, tubing, and packers are used to raise the hydrocarbons to the surface.

SUMMARY

This disclosure describes systems and methods related to controlling a wellbore pressure. During rig operation on the well, this approach fills a volume of a wellbore between a casing and a tubing positioned in the casing with a fluid and then injects gas into the volume. The tubing stings into a tubing-packer sealing assembly attached to the wellbore casing creating a confined tubing casing annulus. A reservoir fluid flows through the tubing to heat the volume of the confined tubing casing annulus, expanding a fluid volume and compressing a gas volume to maintain a pressure in the confined tubing casing annulus between the casing and the tubing below a first threshold pressure.

In one aspect, a method includes disposing a tubing within a casing of a wellbore formed from a surface to a subsurface reservoir through a subterranean zone. The tubing and the casing form a tubing casing annulus. The method includes installing a tubing-packer sealing assembly at a downhole location within the casing. The tubing-packer sealing assembly seals a downhole portion of the wellbore downhole of the downhole location from an uphole portion of the wellbore uphole of the downhole location. The tubing is disposed in the uphole portion.

The method includes filling the tubing casing annulus in the uphole portion with an annulus fluid. In some implementations, filling the tubing casing annulus with the annulus fluid includes flowing the annulus fluid through a wellhead assembly coupled to the wellbore into the tubing casing annulus. In some cases, flowing the annulus fluid through the wellhead assembly into the tubing casing annulus includes flowing the annulus fluid though the tubing into the tubing casing annulus.

The method includes, after filling the tubing casing annulus in the uphole portion with the annulus fluid, injecting a volume of inert gas into the tubing casing annulus in the uphole portion causing an equal volume of the tubing casing annulus fluid to be flowed out of the wellbore. In some implementations, injecting the inert gas into the tubing casing annulus includes displacing a portion of the annulus fluid from the tubing casing annulus. In some implementations, injecting the inert gas into the tubing casing annulus includes flowing the inert gas through a tubing casing annulus valve into the tubing casing annulus.

The method includes, after injecting the volume of the inert gas, sealing the annulus fluid and the inert gas in the tubing casing annulus.

In some implementations, the method includes flowing a fluid from the subsurface reservoir in the wellbore through the tubing. In some cases, flowing the fluid from the subsurface reservoir through the tubing increases a pressure in the tubing casing annulus below a first threshold pressure.

In some implementations, the inert gas is a helium gas and the annulus fluid is an inhibited diesel fluid or a brine.

In some implementations, the method further includes flowing a fluid from the subsurface reservoir fluidly coupled to the wellbore through the tubing to a surface of the Earth. The method can further include, responsive to flowing the fluid from the subsurface reservoir through the tubing, heating the annulus fluid and the inert gas. The method can further include, responsive to heating the inert gas, increasing a pressure in the tubing casing annulus. The method can further include, responsive to increasing the pressure in the tubing casing annulus, compressing the inert gas at a higher rate than the annulus fluid to maintain the pressure of the tubing casing annulus below a first threshold pressure.

In another aspect, a method includes filling a volume of a wellbore casing with a tubing positioned in the wellbore casing with a fluid. The method includes injecting a gas into the volume.

The method includes, stinging-in the tubing into a tubing-packer sealing assembly to seal the tubing to a packer of the tubing-packer sealing assembly creating a seal. The method includes flowing a reservoir fluid through the tubing to heat the volume, expanding a fluid volume and compressing a gas volume to maintain a pressure in the volume of the wellbore casing below a first threshold pressure.

In some implementations, the method further includes, when the tubing is stung out from the tubing-packer sealing assembly, filing the volume of the wellbore casing with a tubing positioned in the wellbore casing with the fluid includes flowing the fluid through the tubing into the volume, and injecting the gas into the volume causes a portion of the fluid to flow back into the tubing. In some cases, the volume is a tubing casing annulus defined by an inner surface of the wellbore casing, an outer surface of the tubing, and a top surface of the tubing-packer sealing assembly.

In some implementations, the method further includes sealing the fluid and the gas in the volume.

In some implementations, injecting the gas into the volume displaces a portion of the fluid from the wellbore.

Implementations of the present disclosure can realize one or more of the following advantages. These systems and methods can improve personnel and environmental safety. For example, maintaining the wellbore pressure below a maximum threshold can prevent the wellbore or wellbore components from rupturing from an overpressure condition and injuring personnel near the wellbore or release caustic or harmful wellbore fluids to the environment. In some instances, the wellbore casing can rupture from an overpressure condition, contaminating water bearing formations which had been protected by the wellbore casing. In some instances, a wellhead component such as a valve, a seal, or a flange can rupture, contaminating the surface of the Earth or injuring personnel.

These systems and methods can increase accuracy of wellbore monitoring. For example, excessive bleed off of the wellbore annulus to maintain pressure can result in low wellbore annulus fluids levels which can cause false indications of a wellbore casing leak. By reducing or eliminating bleed off operations due to a wellbore annulus pressure change, wellbore fluid levels can be maintained, increasing accuracy of wellbore monitoring.

These systems and methods can reduce wellbore component corrosion. For example, maintaining the level of the wellbore annulus fluid (which can contain corrosion reducing or corrosion inhibiting chemicals and components) covering wellbore components can reduce wellbore component corrosion.

These systems and methods can reduce material waste. For example, less wellbore annulus fluid can be required to maintain pressure since wellbore annulus fluid is no longer lost to bleed off operations.

These systems and methods can reduce unnecessary actions from a field engineer. For example, excessive bleed-off of annulus fluid can result in creating an annulus vacuum which can give false indications of a casing leak and warrant unnecessary actions from the field engineer. By reducing excessive bleed-off, unnecessary actions from the field engineer can be reduced.

These systems and methods can reduce corrosion of wellbore tubulars. For example, excessive bleed-off can create a vacuum in the tubing casing annulus which can allow oxygen to ingress into the tubing casing annulus volume and accelerate corrosion of well tubulars. Maintaining the pressure in the tubing casing annulus can reduce oxygen ingress, reducing the rate of corrosion of wellbore tubulars.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure relates to controlling a pressure of a wellbore annulus. During rig operation on the well, this approach fills the wellbore annulus, which is defined by a wellbore casing and a tubing positioned in the wellbore casing, with an annulus fluid. The annulus fluid is then pressurized by an inert gas to displace an equal volume of the annulus fluid in the top portion of annulus. The wellbore annulus is then sealed. The annulus fluid and the inert gas have different coefficients of thermal expansion and compressibility factors.

When a formation fluid is flowed through the tubing, the annulus fluid and the inert gas are heated. The pressure of the wellbore annulus increases below a high pressure threshold due to presence of a gas column which is easily compressible. The tubing, casing, wellhead, and other wellbore components are protected from an over pressure condition. The pressure of the wellbore annulus is controlled by the presence of the buffer gas column in the annulus.

Figure 1A:
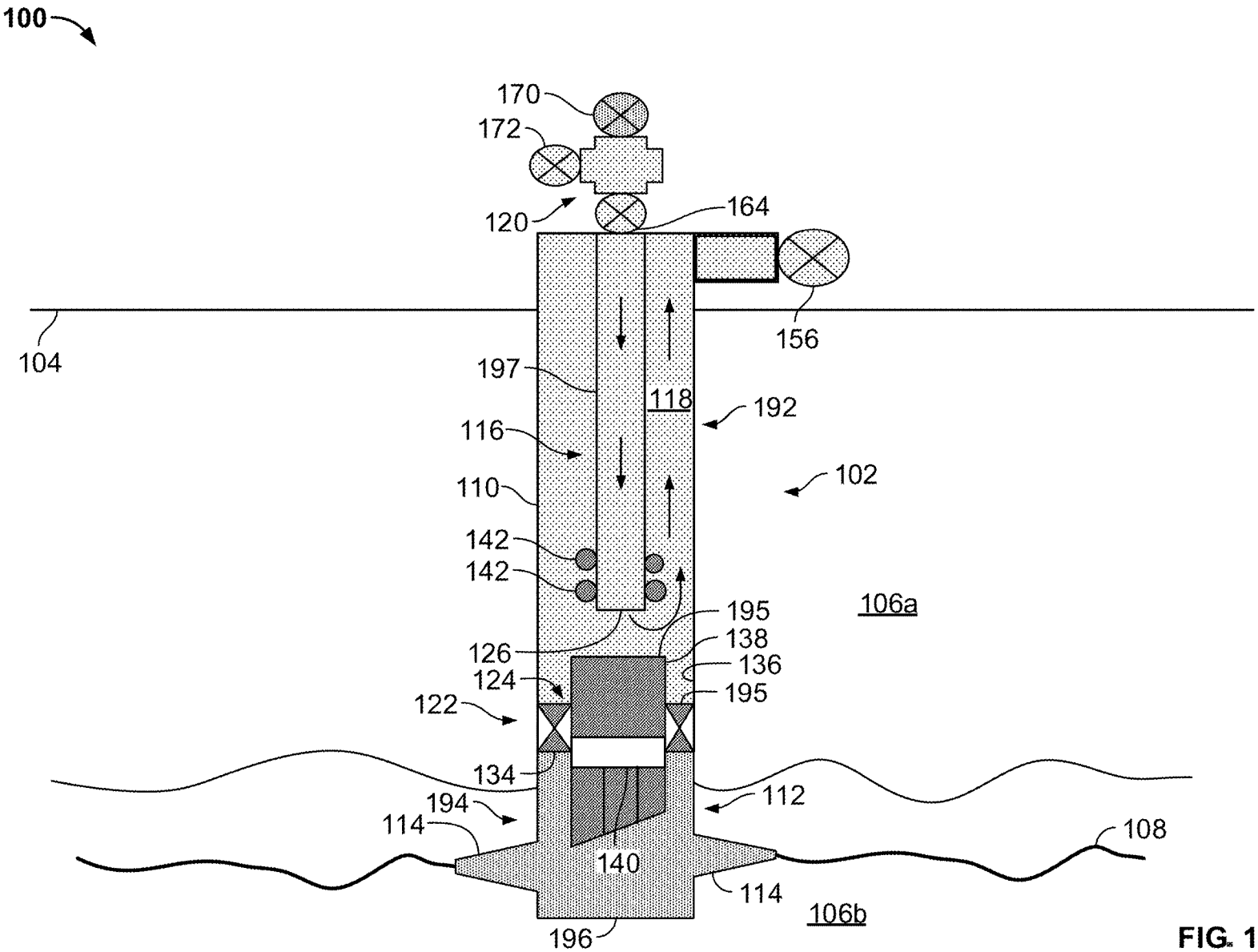
FIGS. 1A-1C are schematic views of a wellbore annulus pressure control system.
Figure 1B:
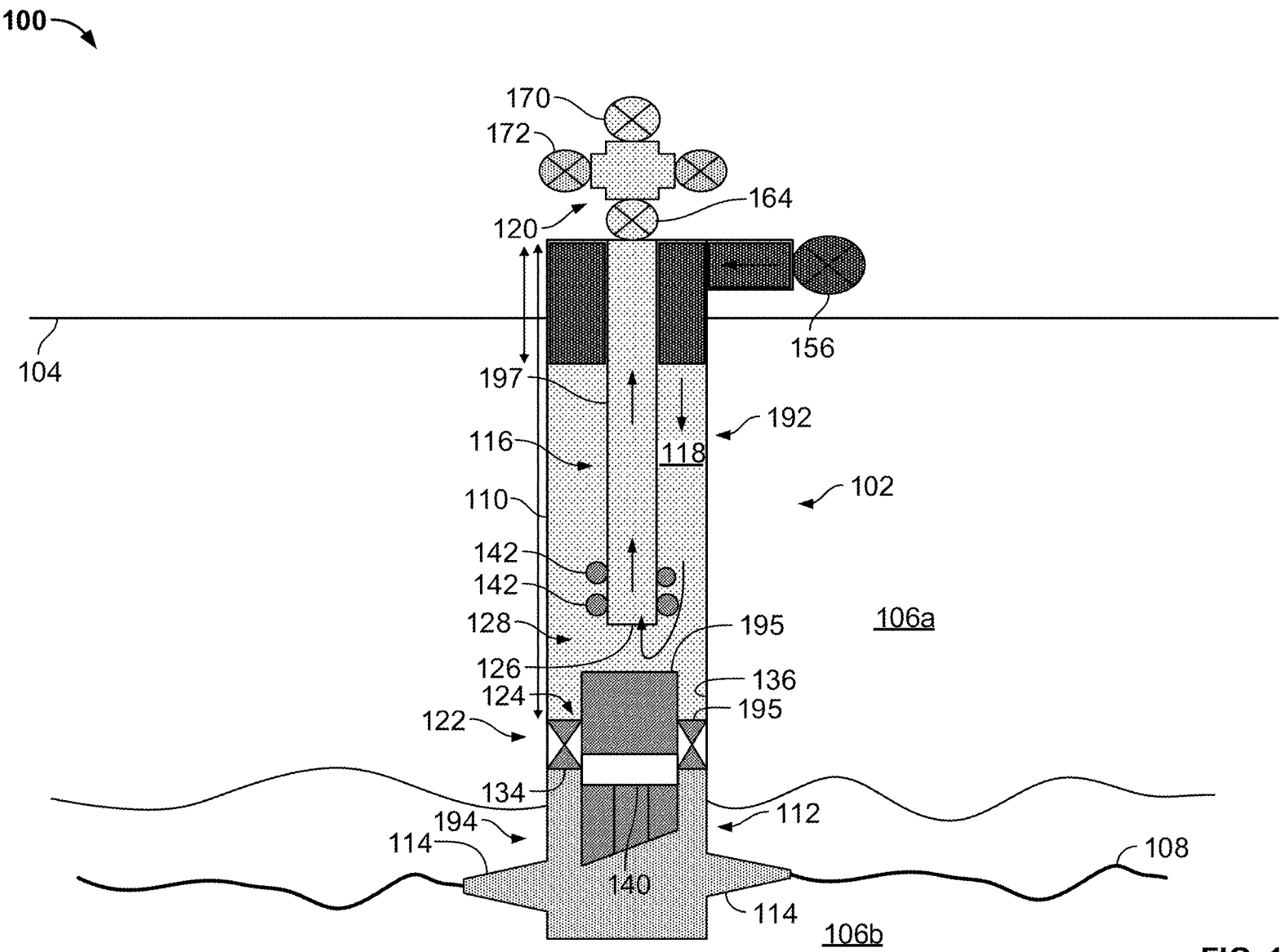
Figure 1C:
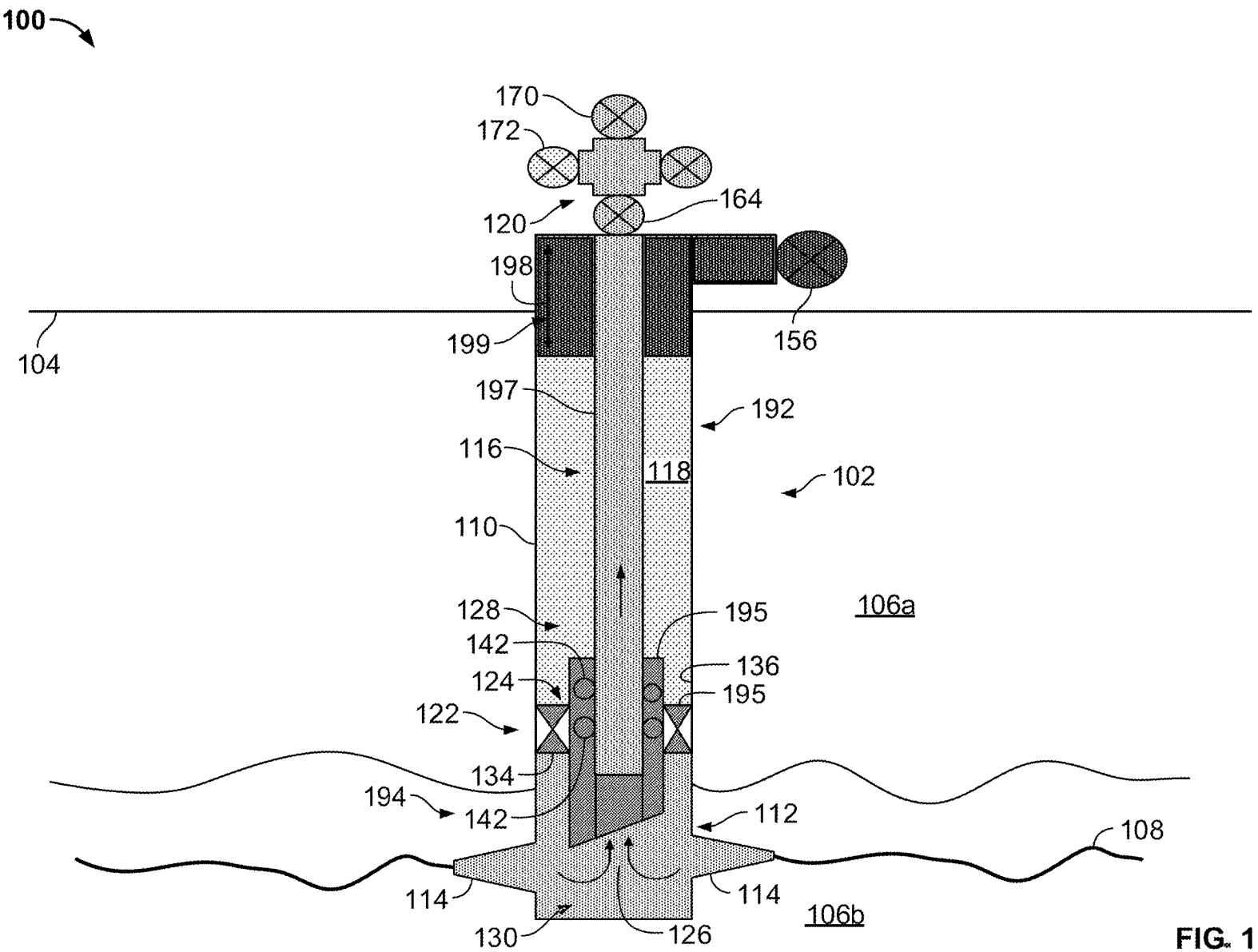

FIGS. 1A-1C are schematic views of a wellbore annulus pressure control system. Referring to FIG. 1A, the wellbore annulus pressure control system 100 includes a wellbore 102 with a casing 110 and a tubing 116 extending through the casing 110. The casing 110 and the tubing 116 define an annulus 118, that is, a hollow cylindrical void between two tubes. During rig operation on wellbore 102, the annulus 118 is filled with an annulus fluid and an inert gas and then sealed. The annulus fluid and the inert gas have different coefficients of thermal expansion and compressibility factors, so when a formation fluid 108 flows through the tubing 116, the annulus fluid and the inert gas are heated and the annulus fluid and the inert gas compress at different rates, maintaining the pressure of the annulus 118 below the high pressure threshold. The annulus 118 is sealed at a surface 104 of the Earth by a wellhead assembly 120 and at a first downhole location 122 in the wellbore 102 by a tubing-packer sealing assembly 124.

The wellbore 102 extends from a surface 104 of the Earth through subterranean geologic formations 106*a* (a subterranean zone) and 106*b* (a subsurface reservoir). Some formations, such as subterranean geologic formation 106*b*, contain formation fluids 108. In other words, subterranean geologic formation 106 can be a subsurface reservoir. The formation fluids 108 can be in the form of liquids and gases. For example, the formation fluids 108 can be water or hydrocarbons. The formation fluids 108 have a temperature and a pressure. In some instances, the temperature of the formation fluids 108 in the subterranean geologic formation 106*b* is between 220 and 250° F. In some instances, the pressure of the formation fluids 108 in the subterranean geologic formation 106*b* can be between 3300 and 3800 psig. In some cases, the wellbore annulus pressure control system 100 has a working pressure of 3000 psig and a tested pressure in the field of 1500 psig.

The wellbore annulus pressure control system 100 includes a casing 110 positioned in the wellbore 102 to seal the wellbore from the subterranean geologic formations 106*a* and 106*b*. The casing 110 can include multiple components such as a metal pipe, cement, a liner, and hangers. In some cases, the pipe is steel or a steel alloy. The components can be arranged in various forms such as a surface conductor, surface casing, intermediate casing, or a production casing. The casing 110 includes a perforated section 112 with perforations 114 (holes in the perforated section 112) which allow the formation fluids 108 to flow into the casing 110 from the subterranean geologic formation 106*b*. In some cases, the casing 110 has an outer diameter of between two and fifty inches.

The wellbore annulus pressure control system 100 includes the tubing 116 extending from the surface 104 through the wellbore 102 and the casing 110 into the perforated section 112. The tubing 116 conducts the formation fluids 108 from the perforated sections 112. In some cases, the tubing 116 is metal. For example, the tubing 116 can be a steel or a steel alloy. In some cases, the tubing 116 has an outer diameter between two and twenty inches.

The tubing 116 can be stung into or out from the tubing-packer sealing assembly 124. For example, as shown in FIG. 1A, the tubing 116 is stung out of the tubing-packer sealing assembly 124. While constructing the wellbore 102, the tubing 116 is first stung into a packer 134 of the tubing-packer sealing assembly 124 and a plug 140 is set below the packer 134. The plug 140 can help in displacing and placing the annulus fluid into tubing casing annulus 118 as shown in FIG. 1A. The plug 140 can be removed after stinging the tubing 116 into the packer 134 to seal the wellbore 102 as described in reference to FIG. 1C, for example, before putting the wellbore 102 on production.

Referring to FIG. 1A, the tubing 116 is stung out of the tubing-packer sealing assembly 124. An annulus fluid (inhibitor diesel or brine in pumped from wellhead assembly 120 and fills the tubing casing annulus 118 up to a tubing casing annulus (TCA) valve 156 of the wellhead assembly 120 which remains open during tubing casing annulus 118 refilling and then remains closed during normal wellbore 102 operation. The annulus 118 can be referred to as a tubing casing annulus. The volume of the tubing casing annulus (that is, the annulus) is defined by an inner surface 136 of the casing 110, an outer surface 197 of the tubing 116, a top surface 195 of the tubing-packer sealing assembly 124.

Referring to FIG. 1A, the tubing-packer sealing assembly 124 includes the packer 134 to couple to the inner surface 136 of the casing 110 and a tubing seal assembly 142 which is positioned in the packer 134 (when sting in as shown in FIG. 1C). The packer 134 and the tubing seal assembly 142 are configured to fluidically seal against the tubing 116 to prevent the formation fluids 108 in the perforated section 112 from entering the annulus 118 and annulus fluid from leaking into the perforated section 112.

The tubing seal assembly 142 includes multiple seals coupled to the tubing 116. The seals seal between the tubing 116 and an inner surface 144 of the tubing-packer seal assembly 124 to prevent the formation fluids 108 in the perforated section 112 from entering the annulus 118 and annulus fluid from leaking into the perforated section 112. The seals can be a metal, a composite, or an elastomer.

The inert gas and the annulus fluid can be flowed into and out of the wellbore 102 by an inert gas system (not shown) and an annulus fluid system (not shown). The inert gas system and the annulus fluid system can be fluidically coupled to the wellbore 102 by the wellhead assembly 120 and are positioned on the surface 104 of the Earth. The wellhead assembly 120 controls the flow of the inert gas, the annulus fluid, and the formation fluid 108 into and out of the wellbore 102. Once the wellbore 102 is completed by the rig and annulus fluid and gas are filled into the tubing casing annulus 118 and are in place, only the wellhead assembly 120 valves and TCA valve 156 will remain in place. In some cases, pressure gauges (not shown) can be installed to record tubing casing annulus 118 pressure. The TCA valve 156 can be opened to bleed tubing casing annulus 118 excess pressure when required. Also, the same TCA valve 156 can be used to refill the tubing casing annulus 118 when more gas is required in the future. The inert gas system and the annulus fluid system can include various sources (for example, tanks or cylinders), conduits, pumps, gauges, and sensors as required to perform the filling and bleeding functions.

The wellhead assembly 120 has multiple control valves including a master valve 164, a wing valve 172, and a crown valve 170 which open and close to control various fluid flows into and out of the wellhead assembly 120. The master valve 164 is coupled to the wellbore 102 to control fluid flow into and out of the wellbore 102. The TCA valve 156 opens and closes to flow the inert gas from the inert gas system into the wellbore 102. The master valve 164, the wing valve 172, the crown valve 170, and the TCA valve 156 can be manually operated or remotely operated from a controller (not shown) during normal rig operation. The controller can be implemented as a computer system including one or more processors and a computer-readable medium storing computer instructions executable by the one or more processors to perform operations described here including operations to control opening and closing of each valve described in this specification.

The inert gas has a coefficient of thermal expansion and a compressibility factor. The inert gas has high compressibility and expandability as compared to normal inhibited brine or diesel fluid. In this implementation, the inert gas is helium. However, nitrogen can also be used.

The annulus fluid has a coefficient of thermal expansion and a compressibility factor. In this implementation, the annulus fluid is an inhibited fluid such as diesel fuel or brine. The inhibited fluid contains chemicals to prevent or reduce a rate of corrosion of the wellbore components. Filling the annulus 118 and maintaining a threshold level, quantity, or volume of inhibited fluid in the annulus 118 can reduce corrosion and increase the operating life of wellbore components such as the casing 110. The annulus fluid should be clean and solid free.

Referring to FIG. 1C, after injecting the volume of the inert gas into the annulus 118, the TCA valve 156 is closed. Sealing the annulus fluid and the inert gas in the annulus 118 also includes stinging-in the tubing 116 to the packer 134 in the tubing-packer sealing assembly 124. All these tubing 116 sting-in and out of the packer 134 operations are done while the rig is on location during the final phase of the wellbore 102 completion process.

Referring to FIG. 1C, the master valve 164 is opened to initiate flow of the formation fluids 108 from the perforated section 112 through the tubing 116 into the wellhead assembly 120. The TCA valve 156 remains shut. The formation fluids 108 are at a higher temperature than the tubing 116 and the annulus 118. The flow of the formation fluids 108 through the tubing 116 from the perforated section 112 to the surface 104 heats the annulus fluid and the inert gas in the annulus 118 causing the annulus pressure to increase. Without the inert gas acting as a buffer, the pressure in the annulus 118 can exceed a high pressure threshold, damaging wellbore 102 components. However, the inert gas acts as a buffer or cushion, so that the annulus pressure increases to a value less than the high pressure threshold.

The following is an example of heating the annulus fluid without the inert gas acting as a buffer using an inhibited diesel fuel. The inhibited diesel fuel has co-efficient of thermal expansion of approximately 0.00046/° F. and a compressibility factor of approximately $1.5\text{-}2.16\times10^5$ psi. A volume of the annulus 118 is 200 bbl. The increase in average temperature of the annulus 118 (the annulus fluid) after initiating formation fluid 108 flow is 42° F. This results in an equivalent of 3.86 bbls of inhibited diesel fuel of volume expansion.

$$42^\circ\text{ F.}\ X\ \frac{0.00046}{^\circ\text{ F.}}\ X\ 200\text{ bbls} = 3.86\text{ bbls} \tag{1}$$

Since the volume of the annulus 118 is fixed (confined), the inhibited diesel fuel undergoes compression to maintain the same volume. This results in tremendous increase in TCA pressure. The pressure increase can reach up to 3377 psig as shown in the below example calculations. dP is the change in pressure in the annulus. V is the annulus volume. dV is the change in equivalent volume.

$$\text{Compressibility factor} = -\frac{dP}{\left(\frac{dV}{V}\right)} \tag{2}$$

$$dP = \text{Compressibility factor}\left(\frac{dV}{V}\right) \tag{3}$$

$$dP = 1.75\times10^5\times3.86\div200 = 3377\text{ psi} \tag{4}$$

As these calculations show, the pressure in the annulus 118 can increase significantly after putting the wellbore 102 on production after completion of the wellbore 102. In some cases, a rated wellhead pressure is 3000 psig. In such a case, one or more components of the wellhead assembly 120 could rupture or fail, causing environmental damage or harming personnel. In some cases, the annular pressure could exceed 4000 psig. In some cases, a typical annular pressure is 1500 psig.

However, by injecting the inert gas to act as a buffer or cushion, the annulus pressure increases to a value less than the allowable high pressure of the tubing casing annulus 118 (that is ≤1500 psig of tested pressure of the tubing casing annulus 118 during rig operation after stinging-in the tubing 116 into the packer 134 to seal the wellbore 102) when higher temperature formation fluids 108 is flowed through the tubing 116. Referring to FIGS. 1B and 1C, the inert gas is injected into the annulus 118, the annulus 118 is sealed, and formation fluid 108 flow is initiated through the tubing 116.

The following is an example of heating the annulus fluid with the inert gas acting as a buffer using the inhibited diesel fuel. The inert gas is injected to fill 8-10% of the annulus 118. The helium gas (the inert gas) has a pressure gradient of 0.06 psi/ft and the inhibited diesel fuel (the annulus fluid) has a pressure gradient of around 0.35 psi/ft. A height 198 of a helium column 199 is approximately 600 ft (which in this example is equivalent of 10% of the volume of the annulus 118).

With the helium gas pressure gradient of 0.06 psi/ft and the inhibited diesel pressure gradient of around 0.35 psi/ft, and a column of roughly 600 ft of Helium gas, which is equivalent of 10% of tubing casing annulus 118 volume (as shown in FIG. 1C), a tubing casing annulus 118 surface back pressure of −180 psig can be achieved. After injecting 10% of tubing casing annulus 118 volume of Helium gas, the tubing 116 can be sting into the packer 134 as shown in FIG. 1C. To reach a tubing casing annulus 118 final pressure in the range of 200-250 psig, additional Helium gas can be injected.

Since the volume of the annulus 118 is fixed (confined), the inhibited diesel fuel and the inert gas undergo compression to maintain same volume. This results in much smaller change in annulus pressure as explained in reference to equations (5) to (8). dP is the change in pressure of the annulus. V is the volume of the annulus. dV is the equivalent change in volume. A volume of the annulus 118 is 200 bbl. The increase in average temperature of the annulus 118 (the annulus fluid) after initiating formation fluid 108 flow is 42° F. Now the inhibited diesel fuel volume has been reduced by 10% (filled by inert gas) to 180 bbl. This results in an equivalent of 3.48 bbls of inhibited diesel fuel of volume expansion.

$$42^\circ\text{ F.}\ X\ \frac{0.00046}{^\circ\text{ F.}}\ X\ 180\text{ bbls} = 3.48\text{ bbls} \tag{5}$$

With the inert gas acting as a buffer using the inhibited diesel fuel, as illustrated in FIG. 1C, the inert gas will provide a pre-charged tubing casing annulus 118 surface pressure of −180-200 psig while the wellbore 102 is shut-in and ready for production. Once the wellbore 102 is put on production and annulus fluid (inhibited diesel fuel) along with the inert gas (Helium) are heated up, the expansion in the inhibited fluid will cause the inert gas to get compressed. This will cause tubing casing annulus surface pressure to increase. Since the inert gas is highly compressible in comparison to liquid, the pressure increase in TCA will not exceed 2-3 times of initial tubing casing annulus charge pressure (~200 psig). Also, when the wellbore 102 is shut-in, the liquid level will shrink but presence of the inert gas will not allow the tubing casing annulus 118 pressure to fall to zero level. A healthy tubing casing annulus positive pressure will be maintained during a wellbore 102 shut-in condition and cool-off period. Thus, an annulus pressure of −400-600 psig can be achieved relative to a 42° F.

Figure 2:
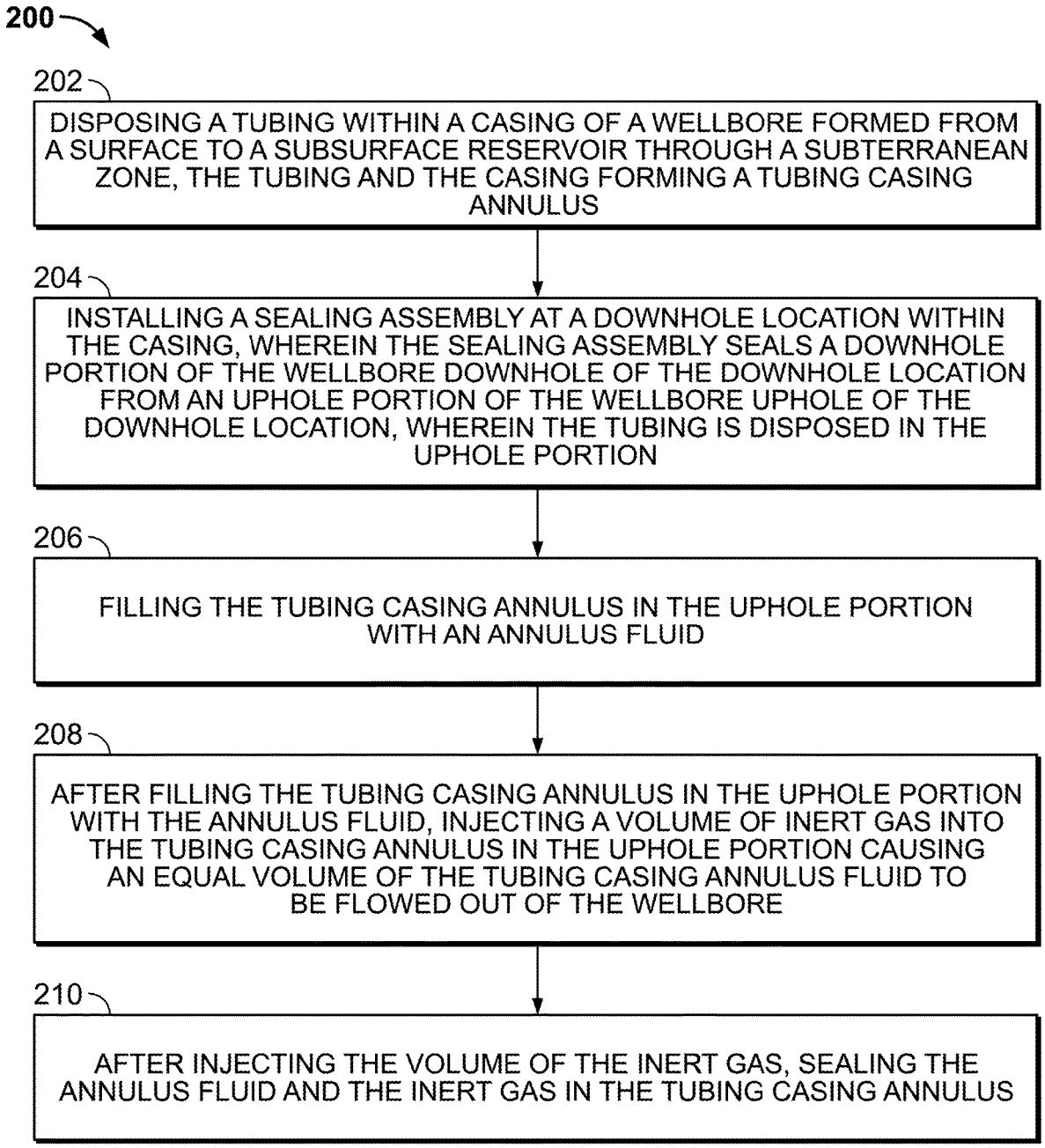
FIG. 2 is a flow chart of an example method of controlling a pressure of a wellbore annulus.

FIG. 2 is a flow chart 200 of an example method of controlling a pressure of a wellbore annulus according to the implementations of the present disclosure. At 202, a tubing is disposed within a casing of a wellbore formed from a surface of the Earth to a subsurface reservoir through a subterranean zone. The tubing and the casing form a tubing casing annulus. In some cases, the inert gas is a helium gas and the annulus fluid is at least one of an inhibited diesel fluid or a brine. For example, the tubing 116 is disposed in the casing 110. The casing 110 seals and separates the wellbore 102 from the subterranean geologic formations 106*a* and 106*b*. The subterranean geologic formation 106*b* is the subsurface reservoir which contains the formation fluid 108.

At 204, a tubing-packer sealing assembly is installed at a downhole location within the casing. The tubing-packer sealing assembly seals a downhole portion of the wellbore downhole of the downhole location from an uphole portion of the wellbore uphole of the downhole location. The tubing is disposed in the uphole portion. In some cases, filling the tubing casing annulus with the annulus fluid includes flowing the annulus fluid through a wellhead assembly coupled to the wellbore into the tubing casing annulus. In some implementations, flowing the annulus fluid through the wellhead assembly into the tubing casing annulus includes flowing the annulus fluid though the tubing into the tubing casing annulus. For example, the tubing-packer sealing assembly 124 is positioned at the first downhole location 122 to seal the uphole portion 192 of the wellbore from the downhole portion 194. As shown in FIG. 1A, the tubing 116 is stung out of the packer 134 from the tubing-packer sealing assembly 124. While constructing wellbore 102, the tubing 116 is first sting into the packer 134 and the plug 140 is set below the packer 134. The plug 140 helps in displacing and placing annulus fluid into the tubing casing annulus 118. The plug 140 prevents annulus fluid from flowing into the subterranean geologic formation 106*b* (the subsurface reservoir) containing the formation fluid 108. The annulus 118 is filled by flowing the annulus fluid from the annulus fluid system through the tubing 116 and into the annulus 118. The wellhead assembly 120 includes the master valve 164, the wing valve 172, and the crown valve 170, which all control various fluid flows into and out of the wellhead assembly 120.

At 206, the tubing casing annulus is filled in the uphole portion with an annulus fluid. For example, by flowing the annulus fluid (inhibited diesel fuel or brine) through the tubing 116 and into the annulus 118, the annulus 118 is filled with the annulus fluid.

At 208, after filling the tubing casing annulus in the uphole portion with the annulus fluid, a volume of inert gas is injected into the tubing casing annulus in the uphole portion causing an equal volume of the tubing casing annulus fluid to be flowed out of the wellbore.

At 210, after injecting the volume of the inert gas, the annulus fluid and the inert gas are sealed in the tubing casing annulus. Sealing the annulus fluid and the inert gas in the tubing casing annulus can include shutting TCA valve and stinging-in the tubing into the tubing-packer sealing assembly.

In some cases, controlling the pressure of the wellbore annulus further includes flowing a fluid from the subsurface reservoir in the wellbore through the tubing. Flowing the fluid from the subsurface reservoir through the tubing can increase a pressure in the tubing casing annulus below a first threshold pressure. For example, the master valve 164 can be opened to flow the formation fluids 108 through the tubing 116 which heats the annulus fluid and the inert gas in the annulus 118, and since the annulus 118 is a sealed volume, the pressure increases.

In some cases, controlling the pressure of the wellbore annulus further includes flowing a fluid from the subsurface reservoir fluidly coupled to the wellbore through the tubing to a surface of the Earth; responsive to flowing the fluid from the subsurface reservoir through the tubing, heating the annulus fluid and the inert gas; responsive to heating the inert gas, increasing a pressure in the tubing casing annulus; and responsive to increasing the pressure in the tubing casing annulus, compressing the inert gas at a higher rate than the annulus fluid to maintain the pressure of the tubing casing annulus below a first threshold pressure. For example, the master valve 164 can be opened to flow the formation fluids 108 through the tubing 116 which heats the annulus fluid and the inert gas in the annulus 118, and since the annulus 118 is a sealed volume, the pressure increases but is maintained less than the high pressure threshold (i.e., the first threshold pressure).

Figure 3:
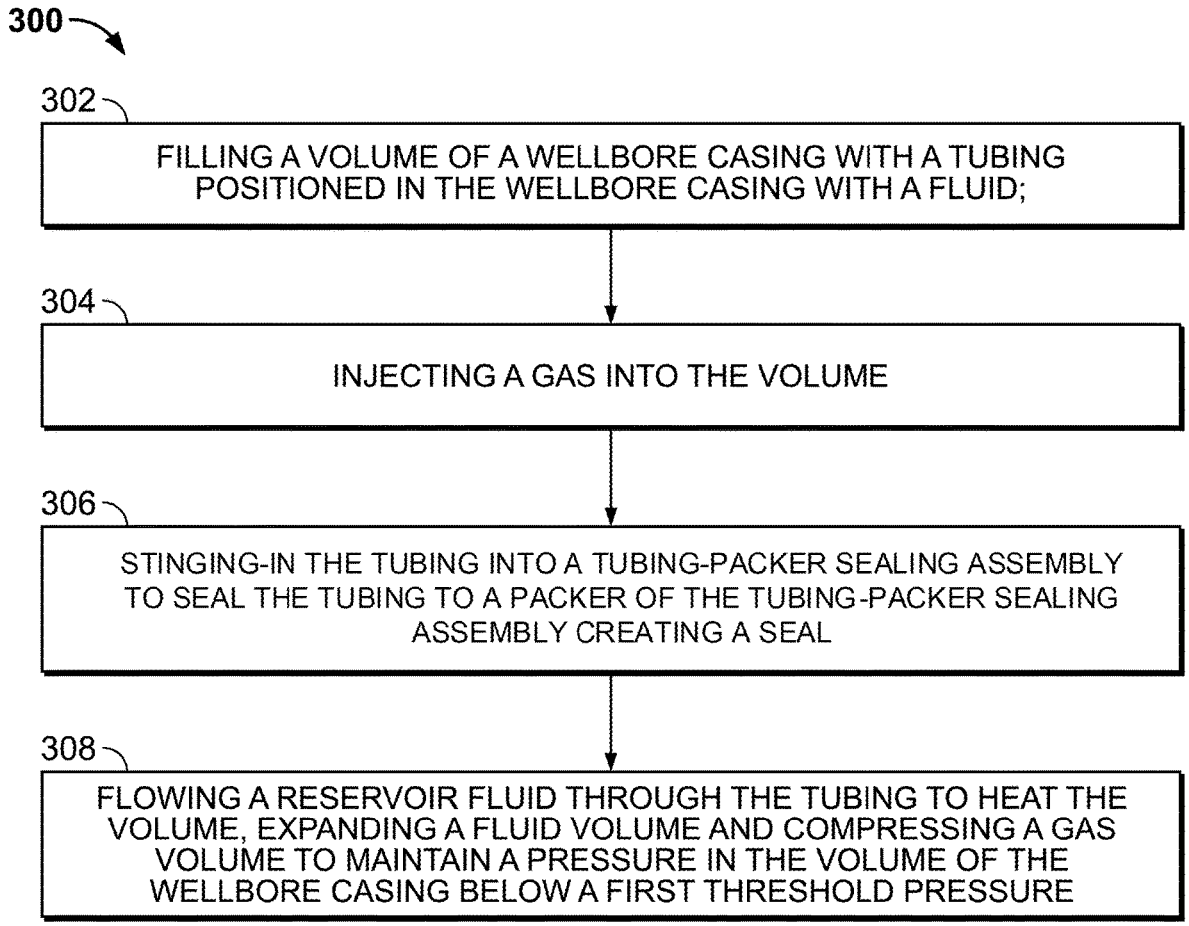
FIG. 3 is a flow chart of another example method of controlling a pressure of a wellbore annulus.

FIG. 3 is a flow chart 300 of another example method of controlling a pressure of a wellbore annulus according to the implementations of the present disclosure. At 302, a volume of a wellbore casing with a tubing positioned in the wellbore casing is filled with a fluid. In some cases, the volume is a tubing casing annulus defined by an inner surface of the wellbore casing, an outer surface of the tubing, and a top surface of the sealing assembly. For example, the wing valve 172 is opened, the master valve 164 is opened, the TCA valve 156 is aligned to allow annulus fluid from the annulus fluid system into the wellhead assembly 120 and down the tubing 116, out the downhole opening 126, and back up into the annulus 118.

At 304, a gas is injected into the volume. In some cases, injecting the gas into the volume displaces a portion of the fluid from the wellbore. In some cases, injecting the gas into the volume includes actuating a tubing casing annulus valve coupled to the wellbore casing and flowing the gas from the inert gas system. For example, TCA valve 156 is opened, allowing flow from the inert gas into the annulus 118.

At 306, the tubing is stung-in into a tubing-packer sealing assembly to seal the tubing to a packer of the tubing-packer sealing assembly creating a seal.

At 308, a reservoir fluid is flowed through the tubing to heat the volume, expanding a fluid volume and compressing a gas volume to maintain a pressure in the volume of the wellbore casing below a first threshold pressure. In some implementations, responsive to decreasing the pressure in the volume, controlling the pressure of the wellbore annulus includes increasing the gas volume to maintain the pressure of the volume above a second threshold pressure where the second pressure threshold is lower than the first threshold pressure. In some implementations, flowing the reservoir fluid through the tubing includes actuating a wellhead valve assembly coupled to the wellbore casing and the tubing. For example, the master valve 164 can be opened to flow the formation fluids 108 through the tubing 116 which heats the annulus fluid and the inert gas in the annulus 118, and since the annulus 118 is a sealed volume, the pressure increases. For example, the master valve 164 can be opened to flow the formation fluids 108 through the tubing 116 which heats the annulus fluid and the inert gas in the annulus 118, and since the annulus 118 is a sealed volume, the pressure increases but is maintained less than the high pressure threshold (i.e., the first threshold pressure).

Although the following detailed description contains many specific details for purposes of illustration, it is understood that one of ordinary skill in the art will appreciate that many examples, variations, and alterations to the following details are within the scope and spirit of the disclosure. Accordingly, the example implementations described herein and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A method comprising:

installing a tubing-packer sealing assembly at a downhole location within a casing of a wellbore formed from a surface to a subsurface reservoir through a subterranean zone, the tubing-packer sealing assembly sealing a downhole portion of the wellbore downhole of the downhole location from an uphole portion of the wellbore uphole of the downhole location;

disposing a tubing within the casing of a wellbore formed from a surface to a subsurface reservoir through a subterranean zone, the tubing and the casing forming a tubing casing annulus in the uphole portion uphole from the tubing-packer sealing assembly;

installing a tubing-packer sealing assembly at a downhole location within the casing, wherein the tubing-packer sealing assembly seals a downhole portion of the wellbore downhole of the downhole location from an uphole portion of the wellbore uphole of the downhole location, wherein the tubing is disposed in the uphole portion;

flowing an annulus fluid through a wellhead assembly coupled to the wellbore into the tubing casing annulus uphole from the tubing-packer sealing assembly;

responsive to flowing the annulus fluid through the wellhead assembly into the tubing casing annulus uphole from the tubing-packer sealing assembly, filling the tubing casing annulus in the uphole portion with the annulus fluid;

after filling the tubing casing annulus in the uphole portion with the annulus fluid, injecting a volume of inert gas into the tubing casing annulus in the uphole portion causing an equal volume of the tubing casing annulus fluid to be flowed out of the wellbore;

after injecting the volume of inert gas, stinging-in the tubing into a tubing-packer sealing assembly to seal the tubing to a packer of the tubing-packer sealing assembly; and responsive to stinging-in the tubing into the tubing-packer sealing assembly, i) sealing the annulus fluid and the inert gas in the tubing casing annulus ii) fluidly coupling a downhole end of the tubing with the downhole portion of the wellbore.

2. The method of claim 1, wherein flowing the annulus fluid through the wellhead assembly into the tubing casing annulus comprises flowing the annulus fluid though the tubing into the tubing casing annulus.

3. The method of claim 1, wherein injecting the inert gas into the tubing casing annulus comprises displacing a portion of the annulus fluid from the tubing casing annulus.

4. The method of claim 1, wherein injecting the inert gas into the tubing casing annulus comprises flowing the inert gas through a tubing casing annulus valve into the tubing casing annulus.

5. The method of claim 1, further comprising flowing a fluid from the subsurface reservoir in the wellbore through the tubing.

6. The method of claim 5, wherein flowing the fluid from the subsurface reservoir through the tubing increases a pressure in the tubing casing annulus below a first threshold pressure.

7. The method of claim 1, wherein:

the inert gas is a helium gas; and the annulus fluid comprises at least one of an inhibited diesel fluid or a brine.

8. The method of claim 1, further comprising:

flowing a fluid from the subsurface reservoir fluidly coupled to the wellbore through the tubing to the surface of the Earth;

responsive to flowing the fluid from the subsurface reservoir through the tubing, heating the annulus fluid and the inert gas;

responsive to heating the inert gas, increasing a pressure in the tubing casing annulus; and responsive to increasing the pressure in the tubing casing annulus, compressing the inert gas at a higher rate than the annulus fluid to maintain the pressure of the tubing casing annulus below a first threshold pressure.

9. The method of claim 1, further comprising before installing the tubing-packer sealing assembly at the downhole location, installing a plug in the wellbore downhole from the downhole location.

10. The method of claim 1, further comprising after stinging-in the tubing into the tubing-packer sealing assembly, removing the plug from the wellbore.

11. The method of claim 6, further comprising bleeding excess pressure from the tubing casing annulus.

12. The method of claim 11, further comprising operating a tubing casing annulus valve of the wellhead assembly to bleed excess pressure from the tubing casing annulus.

13. The method of claim 6, further comprising:

increasing the volume of inert gas in the tubing casing annulus; and responsive to increasing the volume of inert gas in the tubing casing annulus, maintaining the pressure of the tubing casing annulus above a second threshold pressure, wherein the second pressure threshold is lower than the first threshold pressure.

* * * * *